United States Patent [19]

McCartney

[11] Patent Number: 4,552,076

[45] Date of Patent: Nov. 12, 1985

[54] COAL FIRED FURNACE LIGHT-OFF AND STABILIZATION USING MICROFINE PULVERIZED COAL

[75] Inventor: Michael S. McCartney, Bloomfield, Conn.

[73] Assignee: Combustion Engineering, Inc., Windsor, Conn.

[21] Appl. No.: 673,051

[22] Filed: Nov. 19, 1984

[51] Int. Cl.[4] ..... F23D 1/00

[52] U.S. Cl. ..... 110/347; 110/232; 110/106

[58] Field of Search ..... 110/347, 254, 224, 106, 110/232

[56] References Cited

U.S. PATENT DOCUMENTS

| | | | |
|---|---|---|---|
| 3,273,520 | 9/1966 | Hottenstine | 110/347 |
| 4,090,455 | 5/1978 | McCartney | 110/232 |
| 4,223,640 | 9/1980 | Rochford et al. | 110/347 |
| 4,315,734 | 2/1982 | Ramesohl et al. | 110/347 |
| 4,411,204 | 10/1983 | Hamilton | 110/347 |
| 4,426,939 | 1/1984 | Winship | 110/347 |
| 4,442,783 | 4/1984 | Pajonas et al. | 110/347 |

*Primary Examiner*—Henry C. Yuen

*Attorney, Agent, or Firm*—William W. Habelt

[57] ABSTRACT

A method for the cold start of a pulverized coal-fired furnace (10) without prior warm-up of the furnace wherein a supply of microfine pulverized coal (64) supplied from a micropulverizer (60) is combusted to generate a hot gas which is passed to a load-carrying mill (20) as the drying media for the coal pulverized therein. Pulverized coal entrained in the hot gas passes from the load-carrying mill to the load-carrying burner (18) of the furnace (10) and is ignited therein to produce a warm-up flame. A portion of the microfine pulverized coal (68) may also be admixed with the pulverized coal from the load carrying mill (20) to enhance the reactivity thereof. An additional portion (66) of the microfine pulverized coal may be used to fire a pilot igniter to ignite the pulverized coal supplied to the load-carrying burners (18) from the load-carrying mill (20).

2 Claims, 2 Drawing Figures

COAL FIRED FURNACE LIGHT-OFF AND STABILIZATION USING MICROFINE PULVERIZED COAL

BACKGROUND OF THE INVENTION

The present invention relates to the field of coal-fired furnaces and, more particularly, to pulverized coal-fired furnaces designed as direct-fired systems. More specifically, the present invention is directed to the cold start light-off of a pulverized coal-fired furnace supplied with coal from one or more coal drying and pulverizing mills.

In order to avoid the high cost of oil and gas, electric utilities have increasingly chosen coal as the fuel to fire the furnaces of their steam generating boilers. However, even in coal-fired furnaces, substantial quantities of oil and gas are often used in starting and warming up the furnace. In a typical coal-fired unit, the coal must be pulverized in a pulverizer, often termed a mill, and fired by heated air before it can be burned in the furnace. The heated air used to dry the coal is supplied by a force draft fan that forces the air through a preheater wherein the air is passed and heat exchange with hot combustion products leaving the furnace.

Therefore, it is necessary that the furnace be already operating in order to dry the coal in the load-carrying mill for the coal to be burned in the furnace. Accordingly, in a typical coal-fired furnace, a relatively large oil burner is started by an igniter and operated for a fairly long period of time to warm up the furnace walls and the heat exchange surfaces of the air preheater. Once the furnace has been brought up to temperature, the load carrying mills can be brought on line and pulverized coal supplied to the furnace and ignited by oil or gas igniters associated with the coal burner.

Due to the expense of oil and gas, even when used simply as a warm-up fuel, it has generaly been considered necessary to burn such fuels in order to warm up the furnace since the combustion of pulverized coal with its moisture content is very difficult unless the coal is suitably dried prior to combustion. One proposal to reduce the consumption of oil or gas as a warm-up fuel is discussed in U.S. Pat. No. 4,090,455. As disclosed therein, a direct-fired air heater using oil as a fuel is used at start-up to generate hot air for the load carrying mills. The hot air from the auxiliary direct-fired air heater is mixed with ambient air from the main air preheater and passed to the load carrying mills as the sole source of hot air for drying the coal being pulverized in the mill during startup. The pulverized coal from the load carrying mills is then passed to the furnace and ignited by conventional oil or gas pilot igniters to produce a warm-up flame therein.

Another proposal for minimizing the use of auxiliary fuel such as oil or gas by warming the furnace up on pulverized coal, is discussed in U.S. Pat. No. 4,173,189. An ignition, warm-up and low load stabilization system are disclosed therein wherein a separate pulverizing mill, dedicated for start-up, is used to produce dried pulverized coal for start-up. Hot air from an independent source is supplied to the start-up pulverizer to dry the coal therein. The pulverized coal is exhausted from the pulverizer in the hot air and passed to a separation device wherein the pulverized coal is removed from the air. This separated pulverized coal is then passed in a dense phase stream to coal-fired igniter burners which are used to warm the furnace up.

A further system designed to minimize the use of auxiliary fuel by warming the furnace up on pulverized coal is disclosed in U.S. Pat. No. 4,241,673. As proposed therein, coal is pulverized and dried when the furnace is in normal operation and stored for subsequent use in a storage bin. When it is necessary to warm the furnace up, the pulverized coal is fed to the furnace from the storage bin, typically in a dense phase stream and ignited in the furnace by auxiliary ignition means. Although oil or gas igniters may be used for the auxiliary ignition means, it is disclosed therein that an electric spark ignition means is preferred so as to eliminate oil or gas as an auxiliary fuel and the start-up and warm-up of the furnace.

Accordingly, it is an object of the present invention to provide for the cold start light-off of a pulverized coal furnace utilizing pulverized coal from the load-carrying mills as the premdominant source of fuel for the start-up and warm-up of the furnace while minmizing or eliminating the use of auxiliary fuel such as oil or gas.

SUMMARY OF THE INVENTION

In accordance with the present invention, a supply of microfine pulverized coal having a mean particle size less than about 10 microns, and preferably about 5 microns, is provided for combusting in an auxiliary burner to generate a supply of hot gas. This supply of hot gas generated by the combustion of the microfine pulverized coal is passed to a load-carrying mill for drying and pulverizing coal. The pulverized coal from the load-carrying mill is entrained in the hot gas and passed to a load-carrying burner for introduction into the furnace therethrough. The stream of pulverized coal and gas being directed into the furnace from the load-carrying burner is ignited to establish a flame within the furnace for warming the furnace up. Once the furnace is brought up to temperature, the main air heater can be brought into service and hot air supplied directly to the load-carrying mill from the air heater and the combustion of microfine pulverized coal to generate a hot gas supply terminated. Further, a portion of the microfine pulverized coal may be supplied to and combusted in an igniter burner operatively associated with the load-carrying burner so as to cause the subsequent ignition of the stream of pulverized coal and gas being directed from the load-carrying burner into the furnace, thereby eliminating the necessity of an auxiliary fuel such as oil or gas to supply a pilot igniter. Alternatively, an electrical spark-type igniter may be utilized to ignite the pulverized coal and gas stream being supplied from the load-carrying burner into the furnace.

To further enhance the ignitability of the pulverized coal and gas being directed from the load-carrying burner into the furnace, particularly when utilizing an electric spark-type igniter, a portion of the microfine pulverized coal may be admixed with the pulverized coal produced in the load-carrying pulverizer prior to directing the resultant mixture into the furnace. The microfine pulverized coal, being readily ignitable, will enhance the ignitability of the standard particle size pulverized coal being supplied from the load-carrying mill to the load-carrying burner during start-up and warm-up of the furnace.

BRIEF DESCRIPTION OF THE DRAWING

The present invention may be better understood and the features and advantages of the invention made more evident from the following description of a preferred embodiment thereof with reference to the accompanying drawing wherein.

DETAILED DESCRIPTION OF A PREFERRED EMBODIMENT

Figure 1:
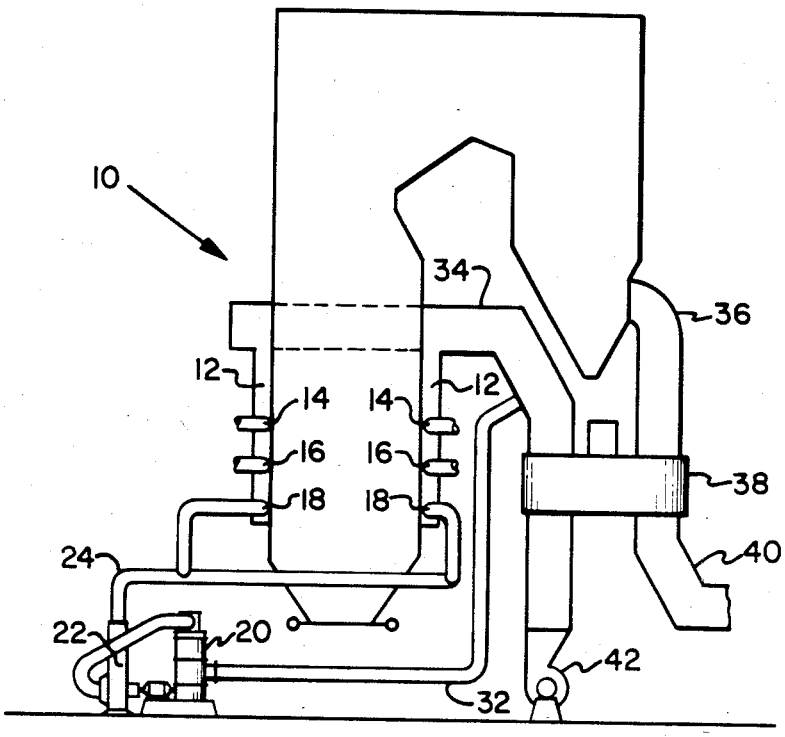
FIG. 1 is a diagrammatic elevational view of a typical coal-fired furnace and the load-carrying coal supply system associated therewith.

Referring now to the drawing, there is depicted therein a furnace 10 having a plurality of burners or coal nozzles 14,16 and 18 disposed in vertically spaced rows with four burners in each row, i.e. with one burner per row mounted in each of the four corners of the furnace, and aimed tangentially to an imaginary circle in the center of the furnace so as to form a rotating vortex flame in accordance with the well known tangentially firing method. To fire the furnace, raw coal is delivered from a storage silo to the load-carrying pulverizer 20 wherein the coal is ground to pulverized coal and dried by hot air, termed primary air, drawn from the hot air outlet duct 34 of the regenerative air preheater 38 through hot air supply duct 32. The pulverized coal is entrained in the pulverizer 20 in the hot air passing therethrough to dry the coal and is drawn from the pulverizer 20 by exhauster 22 and conveyed through the main fuel pipes 24 to the load-carrying burners 18 for combustion in the furnace 10. Typically, a single load-carrying pulverizer 20 will serve all four burners disposed in a single elevation in the four corners of the furnace. Additional pulverizers are typically provided to supply coal to each additional elevation of burners, although it is not uncommon for a single pulverizer to supply all of the burners in two adjacent rows. Therefore, a single load-carrying pulverizer will generally serve a plurality of load-carrying burners ranging from at least two to eight or more.

In normal operation, the hot combustion products formed in the furnace 10 leave the furnace 10 through duct 36 to the air preheater 38 wherein the hot combustion products are passed in indirect heat exchange relationship with ambient air being supplied to the air preheater 38 from the force draft fans 42. The cooled combustion products leave the air preheater 38 through duct 40 to a stack (not shown) for venting to the atmosphere. The hot air heated in the air preheater 38 by indirect heat exchange with the hot combustion products leaving the furnace, is passed through duct 34 to the furnace windboxes 12 disposed in the four corners of the furnace to supply additional air, termed secondary air, for combustion of the pulverized coal introduced into the furnace 10 through the load-carrying burners. Additionally, a portion of the hot air leaving the air heater 10 through duct 34 is passed through duct 32 to the load-carrying pulverizers 20 as discussed above to serve as a media for drying the coal being pulverized in the load-carrying mills 20.

At the start-up of the furnace and during the warm-up stages of furnace operation, the combustion products formed in the furnace 10 and flowing through the duct 36 to the air preheater 38 are relatively cool and do not have sufficient heat therein to impart any significant temperature rise to the ambient air being passed through the air preheater 38 by the forced draft fan 42. Therefore, it is customary in typical pulverized coal-fired furnaces to provide one or more auxiliary oil- or gas-fired burners in the corners of the furnace that are operated at start-up and during warm-up of the furnace to provide sufficient combustion products to permit the preheating of air in the air preheater 38 so that sufficient hot air may be available to start the load-carrying mills 20. However, as mentioned hereinbefore, it would be desirable to eliminate or at least significantly reduce the use of natural gas or oil during start-up and warm-up as a cost saving measure.

Figure 2:
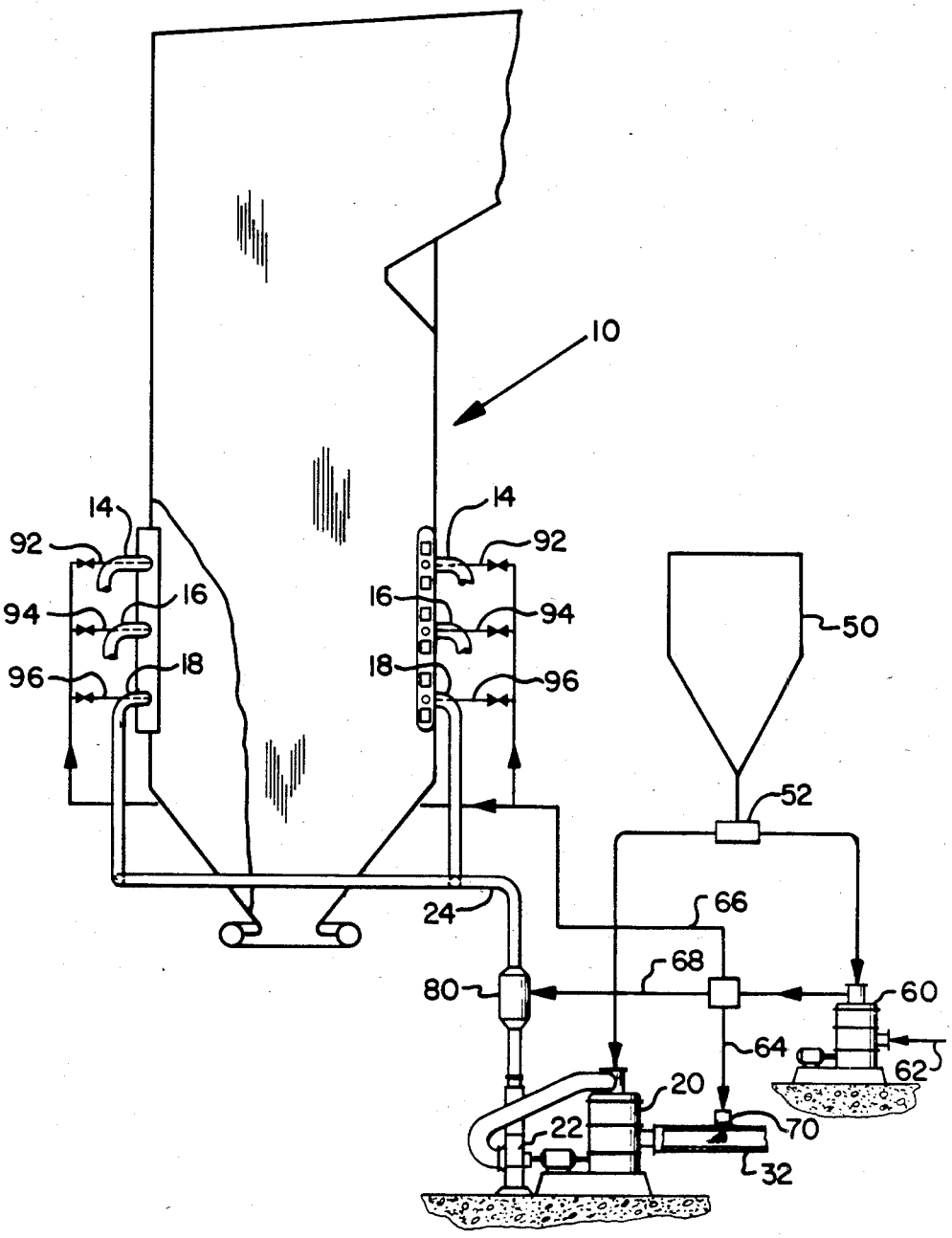
FIG. 2 is a diagrammatic view of such a coal-fired furnace modified to incorporate the start-up coal supply system for carrying out the method of the present invention.

Referring now to FIG. 2, there is depicted therein a fuel supply system that permits start-up and warm-up of a typical pulverized coal-fired furnace in accordance with the present invention with pulverized coal rather than an auxiliary fuel such as oil or gas, as the predominant fuel during start-up and warm-up. To start the furnace 10 on pulverized coal in accordance with the present invention, raw coal, in the form of chunks, is fed from the raw coal storage silo 50 via feeder 52 through line 54 to the auxiliary start-up micro-pulverizer 60. The micro-pulverizer 60 is a fluid powered mill of the type well known in the art which is capable of producing a very fine pulverized coal product. Compressed air or pressurized steam 62 would be supplied to the micro pulverizer 60 not only to drive the pulverizer but also to dry the coal being pulverized therein. Therefore, the micro-pulverizer 60 can be utilized to provide pulverized coal on demand at start-up and during warm-up without the air preheater 38 being in service. The compressed air or pressurized steam 62 supplied to the micro-pulverizer could be made available from auxiliary sources commonly existing at steam generating power plants.

In accordance with the present invention, a first portion 64 of the microfine pulverized coal having a mean particle size of less than about 10 microns supplied from the micro-pulverizer 60 is passed to and combusted within a direct-fired air preheating means to generate a supply of hot gaseous media for drying of coal being pulverized in the load-carrying Pulverizers 20 during start-up and warm-up of the furnace 10. The direct-fired air heater means may comprise any of a number of well known devices such as a direct-fired tubular air heater wherein the microfine pulverized coal is combusted to generate hot combustion products which are passed through a plurality of tubes forming a tube bundle disposed in the air supply duct 32 leading to the mill over which air passing through the duct will pass in indirect heat exchange relationship with the hot combustion products, or a burner, such as duct burner 70 shown in FIG. 2, wherein the microfine pulverized coal is burned directly in the air passing through the air supply duct 32 to generate a hot gaseous mixture of combustion products and air.

Upon the establishment of the flow of hot gaseous media to the load-carrying mill 20 generated from the combustion of the microfine pulverized coal supplied on demand from the micro-pulverizer 60, the load-carrying mill 20 is brought into service to supply pulverized coal to the load-carrying burner 14,16 and 18 for start-up of the furnace 10. To bring the load-carrying pulverizer 20 into service, raw coal is fed from the raw coal storage silo 50 via feeder 52 through line 56 to the load-carrying pulverizer 20. The raw coal is pulverized therein to a particle size of 70% through 200 mesh (i.e. a mean particle size in the range of about 35–40 microns) and is entrained in the hot gaseous mixture and passed therewith through main fuel lines 24 to the load-carrying burners 18 of the furnace 10. The stream of pulverized coal and gaseous mixture being directed from the load-carrying burners 18 into the furnace 10 is ignited to establish a flame within the furnace. The ignition of the stream of pulverized coal and gas from the burners 18 may be accomplished by the use of either oil or gas fired pilot igniters we11 known in the art. Once the furnace has been warmed up such that the combustion products leaving the furnace through exit duct 36 and passing through the air preheater 38 in heat exchange relationship with the air being supplied to the furnace have been heated to sufficient temperature to preheat the hot air leaving the air preheating means 38 and passing through duct 32 to a sufficient temperature to dry the coal within the load-carrying pulverizers 20, the micro-pulverizer 60 may be removed from service.

Further in accordance with the present invention, the oil or gas fired pilot igniters mentioned above may be eliminated and the ignition of the pulverized coal passing into the furnace 10 from the load-carrying burners accomplished through the use of microfine pulverized coal. A second portion 66 of the microfine pulverized coal supplied on demand from the micro pulverizer 60 may be passed to the appropriate coal-fired igniters 92,94,96 operatively associated with the load-carrying burners 14,16 and 18. The microfine pulverized coal would be combusted in the coal-fired igniters 92,94,96 to generate an ignition flame suitable for causing the subsequent ignition of the stream of pulverized coal and gaseous mixture being directed from their associated load-carrying burners into the furnace 10. Because of its very fine particle size, less than about 10 microns and preferably in the range of about 5 microns, the microfine pulverized coal will burn rapidly and have a rate of heat release suitable for igniting a much larger particle size pulverized coal produced in the load-carrying pulverizers 20 and being directed into the furnace through the load-carrying burners. Again, once the furnace 10 has been warmed up to the point that the combustion products exiting the furnace through duct 36 to the air preheater 38 are sufficient to heat the combustion air passing through the air preheater 38 and duct 32 to a temperature sufficient to dry the coal being pulverized in the load-carrying mills 20, the flames associated with each of the load-carrying burners should be sufficiently well established to sustain their own ignition and the supply of microfine coal to the coal-fired igniters could be terminated. However, it may be desirable to maintain the micro-pulverizer 60 in service to continue generating a supply of microfine pulverized coal and continuing the supply of microfine pulverized coal to the coal-fired igniters in order to positively insure ignition stability even though a supply of microfine pulverized coal to the duct burner 70 would be terminated as hot air would now being supplied to the load-carrying mills 20 from the air preheater 38.

In a further aspect of the present invention, a third portion 68 of the supply of microfine pulverized coal generated by the micro-pulverizer 60 is mixed with the pulverized coal product of the load-carrying pulverizer 20. As shown in FIG. 2, the third portion 68 of microfine pulverized coal is passed to mixing means 70 disposed in the main fuel pipe line 24 and mixed therein with the conventional size pulverized coal passing through the line 24 from the load-carrying pulverizer to the load-carrying burners. As the mean particle size of the third portion 68 of the supply of microfine pulverized coal, which is less than about 10 microns, is significantly smaller than the mean particle size of the conventional size pulverized coal produced by the load-carrying mills 20, the addition of the microfine coal to the main fuel stream passing to the load-carrying burners will serve to increase the reactivity of that pulverized coal stream. This, in turn, would enhance the ignitability of the main pulverized coal streams being introduced into the furnace 10 through the load-carrying burners 14,16 and 18. In addition to improving the ignitability of the main fuel stream, the addition of this microfine coal to the main fuel stream should also enhance the flame stability of the main pulverized coal streams thereby improving the turn-down capabilities of the load-carrying burners.

While the method of the present invention has been described and illustrated herein in relation to a pulverized coal-fired tangential furnace, it is to be understood that the method of the present invention may apply to any direct-fired pulverized coal-fired furnace wherein a load-carrying pulverizer supplies the pulverized coal entrained in air or other gaseous media to one or more load-carrying burners of the furnace whether they be mounted in the walls of the furnace or in the corners of the furnace as in the tangential firing method. Further, it is to be understood that the specific embodiment shown in the drawing is merely illustrative of the best mode presently contemplated by the applicant for carrying out the method of the present invention and it is presented solely for purposes of illustration and not limitation.

I claim:

1. A method for the cold start of a pulverized coal-fired furnace system of the type having furnace, a load-carrying burner arranged to direct a stream of pulverized coal and air into the furnace, a load-carrying coal drying and pulverizing mill for providing dried pulverized coal, and conduit means interconnecting the load-carrying mill to the load-carrying burner for conducting the stream of pulverized coal and air from the load-carrying pulverizer to the load-carrying burner, said method comprising:

a. providing a supply of microfine pulverized coal having a mean particle size less than about 10 microns;

b. combusting a first portion of said supply of microfine pulverized coal to generate a supply of hot gas;

c. passing the supply of hot gas generated by the combustion of the first portion of said supply of microfine pulverized coal to the load-carrying mill;

d. supplying raw, coal to be pulverized to the load-carrying mill;

e. pulverizing and drying the raw coal supplied to the load-carrying mill and entraining the resultant pulverized coal therein in the hot gas;

f. conveying the pulverized coal and hot gas from the load-carrying mill through the conduit means to the loading-carrying burners; and g. igniting the stream of pulverized coal and gas being directed from the load-carrying burner into the furnace thereby establishing a flame within the furnace by combusting a second portion of said supply of microfine pulverized coal in an igniter burner operatively associated with the load-carrying burner so as to cause the subsequent ignition of the stream pulverized coal and gas being directed from the load-carrying burner into the furnace.

2. A method as recited in claim 1 further comprising admixing a third portion of said supply of microfine pulverized coal to the pulverized coal produced in the load-carrying pulverizer prior to directing the resultant admixture into the furnace.

* * * * *